US008330776B2

(12) United States Patent
Nagatomo

(10) Patent No.: US 8,330,776 B2
(45) **Date of Patent: *Dec. 11, 2012**

(54) REMOTE CONTROL SYSTEM AND APPLIANCE FOR USE IN THE REMOTE CONTROL SYSTEM

(75) Inventor: Tamio Nagatomo, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/446,280

(22) Filed: Apr. 13, 2012

(65) Prior Publication Data

US 2012/0194560 A1 Aug. 2, 2012

Related U.S. Application Data

(63) Continuation of application No. 11/257,616, filed on Oct. 25, 2005, now Pat. No. 8,179,404.

(30) Foreign Application Priority Data

Oct. 27, 2004 (JP) ..... 2004-311765

(51) Int. Cl.
*G09G 5/00* (2006.01)

(52) U.S. Cl. ..... 345/660; 345/661; 345/676; 341/176; 348/552; 348/569; 348/581; 348/725; 348/734; 725/37; 715/762; 715/763; 715/788; 715/800; 715/810

(58) Field of Classification Search ..... 725/25, 725/135; 341/176; 345/88; 248/734
See application file for complete search history.

(56) References Cited

U.S. PATENT DOCUMENTS

| | | | |
|---|---|---|---|
| 5,663,756 | A | 9/1997 | Biahut et al. |
| 5,963,269 | A | 10/1999 | Beery |
| 6,083,073 | A | 7/2000 | McFarlan et al. |
| 6,094,156 | A | 7/2000 | Henty |
| 6,211,856 | B1 | 4/2001 | Choi et al. |

(Continued)

FOREIGN PATENT DOCUMENTS

JP 2002-354561 12/2002

(Continued)

OTHER PUBLICATIONS

Office Action dated Apr. 25, 2008 issued for the corresponding Chinese Patent Application No. 200510114175.6 and partial English translation thereof.

(Continued)

*Primary Examiner* — Xiao M. Wu
*Assistant Examiner* — Phi Hoang
(74) *Attorney, Agent, or Firm* — Renner, Otto, Boisselle & Sklar, LLP

(57) ABSTRACT

An appliance according to the present invention is operative under instructions from a plurality of control units, which includes a first control unit and a second control unit. The first control unit outputs a first control signal to the appliance to instruct the appliance to perform a predetermined operation. The second control unit outputs a second control signal to the appliance to instruct the appliance to perform the predetermined operation. The appliance includes a receiving section that receives the first and second control signals and an image control section that changes sizes of a particular image to be presented during the predetermined operation depending on whether the receiving section has received the first control signal or the second control signal.

13 Claims, 7 Drawing Sheets

U.S. PATENT DOCUMENTS

| | | | |
|---|---|---|---|
| 6,285,357 | B1 | 9/2001 | Kushiro et al. |
| 6,348,956 | B1 | 2/2002 | Tanigawa et al. |
| 6,359,661 | B1 | 3/2002 | Nickum |
| 6,496,122 | B2 | 12/2002 | Sampsell |
| 6,622,148 | B1 | 9/2003 | Noble et al. |
| 6,795,130 | B2 | 9/2004 | Shibamiya |
| 7,017,173 | B1 | 3/2006 | Armstrong et al. |
| 7,030,845 | B2 | 4/2006 | Maa |
| 7,123,242 | B1 | 10/2006 | Henty |
| 7,394,450 | B2 | 7/2008 | Shibamiya et al. |
| 2002/0056083 | A1 | 5/2002 | Istvan |
| 2002/0059588 | A1 | 5/2002 | Huber et al. |
| 2002/0081092 | A1 | 6/2002 | Ozawa et al. |
| 2002/0122027 | A1 | 9/2002 | Shibamiya et al. |
| 2002/0174433 | A1 | 11/2002 | Baumgartner et al. |
| 2002/0175944 | A1 | 11/2002 | Kolde et al. |
| 2003/0066075 | A1 | 4/2003 | Bahn et al. |
| 2003/0169234 | A1 | 9/2003 | Kempisty |
| 2003/0204272 | A1 | 10/2003 | Niyama et al. |
| 2004/0041723 | A1 | 3/2004 | Shibamiya et al. |
| 2004/0095316 | A1 | 5/2004 | Shibamiya et al. |
| 2004/0128317 | A1 | 7/2004 | Sull et al. |
| 2004/0244056 | A1 | 12/2004 | Lorenz et al. |
| 2004/0257337 | A1 | 12/2004 | Shibamiya et al. |
| 2004/0263377 | A1 | 12/2004 | Risi et al. |
| 2005/0005288 | A1 | 1/2005 | Novak |
| 2005/0125826 | A1 | 6/2005 | Hunleth et al. |
| 2006/0203130 | A1 | 9/2006 | Inoue et al. |

FOREIGN PATENT DOCUMENTS

| | | |
|---|---|---|
| JP | 2003-110875 | 4/2003 |
| WO | 98/20678 A1 | 5/1998 |

OTHER PUBLICATIONS

European Search Report for corresponding European Application No. 05023296.6 dated Jul. 20, 2011.

Mann et al., "Design of Hand-Held Remotes for Older Persons with Impairments", 1994, RESNA, Assistive Technology, vol. 6, No. 2, pp. 140-146.

Co-pending U.S. Appl. No. 11/257,616, filed Oct. 25, 2005.

*FIG.4*

206

| REMOTE CONTROLLER CODE | SCREEN DISPLAY MODE SPECIFYING DATA | OPERATION INSTRUCTING DATA |
|---|---|---|
| 00 | 00 | 00000100 |
| 01 | 00 | 00001000 |
| 02 | 00 | 00010000 |
| ... | ... | ... |
| 50 | 01 | 00000100 |
| 51 | 01 | 00001000 |
| 52 | 01 | 00010000 |
| ... | ... | ... |

207

| REMOTE CONTROLLER CODE | SCREEN DISPLAY MODE SPECIFYING DATA | OPERATION INSTRUCTING DATA |
|---|---|---|
| 00 | 00 | 00010000 (PLAY) |
| 01 | 00 | 00001000 (STOP) |
| 02 | 00 | 00000100 (SETUP) |
| 03 | 01 | 00010000 (PLAY) |
| 04 | 01 | 00001000 (STOP) |
| 05 | 01 | 00000100 (SETUP) |
| . . . | . . . | . . . |

REMOTE CONTROL SYSTEM AND APPLIANCE FOR USE IN THE REMOTE CONTROL SYSTEM

BACKGROUND OF THE INVENTION

1. Field of the Invention

The present invention relates to a remote control system and an appliance for use in the remote control system.

2. Description of the Related Art

Audiovisual (AV) appliances, including DVD (digital versatile disc) recorders and digital TV receivers, are usually operated using a remote controller or an interface presented on a display.

Recently, however, as the functions of those AV appliances have been further diversified, their remote controllers have had an increasing number of buttons. Consequently, those buttons have become smaller and smaller, so have the labels indicating the functions associated with those buttons. Likewise, the interface presented on the screen has become even more complicated and sometimes overly detailed, too. For example, since the digital broadcasting launched, most remote controllers now have additional buttons for using electronic program guides and interactive services. Consequently, the number of remote controllers with 30 or more buttons has been on the rise. As the required operation has been complicated in this manner, a system for controlling an AV appliance using a plurality of remote controllers was proposed in Japanese Patent Application Laid-Open Publication No. 2002-354561, for example.

However, not every user has the required skill to operate such AV appliances easily by manipulating those numerous buttons. That is why each of those AV appliances should provide various degrees of operability and visibility to please users with various levels of operational skills, including those who can hardly use the appliances by themselves and those who can use them easily. That is to say, the AV appliances should not only provide high degrees of visibility and operability for aged users and those who need only simple conventional functions but also fill the needs of users who want to use those advanced functions fully.

If the user wants to use a remote controller with a smaller number of bigger buttons, which is specially designed for non-skilled or aged users, not the remote controller with those complicated functions, he or she has to purchase such a simple remote controller separately from the AV appliance itself. Also, to use the separately purchased, simple remote controller, the user needs to make settings of the remote controller and the AV appliance by himself or herself. Furthermore, to change the interface presented on the screen into an easily usable one, the user has to change the settings of the AV appliance by himself or herself.

Besides, in conventional AV appliances, even if the user changes the remote controllers to use while an interface is being dealt with, the display state of the interface (e.g., the size of the interface on the screen) does not change automatically. Accordingly, to change the display states of the interface, the user has to close the window of the interface once and then change the settings about the display state of the interface by himself or herself. Thus, the user is forced to do time-consuming complicated operations.

In order to overcome the problems described above, an object of the present invention is to provide a remote control system that allows every user with any of various levels of skills to operate his or her favorite remote controller and interface comfortably without doing the troublesome settings of the AV appliance or remote controller by himself or herself and to provide an appliance for such a remote control system.

SUMMARY OF THE INVENTION

An appliance according to a preferred embodiment of the present invention is operative under instructions from a plurality of control units, which includes a first control unit and a second control unit. The first control unit outputs a first control signal to the appliance to instruct the appliance to perform a predetermined operation. The second control unit outputs a second control signal to the appliance to instruct the appliance to perform the predetermined operation. The appliance includes: a receiving section that receives the first and second control signals; and an image control section that changes sizes of a particular image to be presented during the predetermined operation depending on whether the receiving section has received the first control signal or the second control signal.

In one preferred embodiment of the present invention, the first control unit preferably has a first button and preferably outputs the first control signal when the first button is pushed. The second control unit preferably has a second button and preferably outputs the second control signal when the second button is pushed. The first button preferably has a bigger size than the second button. The image control section preferably makes the size of the particular image to be presented when the receiving section receives the first control signal bigger than that of the particular image to be presented when the receiving section receives the second control signal.

In another preferred embodiment, the first control unit preferably has a first button and preferably outputs the first control signal when the first button is pushed. The second control unit preferably has a second button and preferably outputs the second control signal when the second button is pushed. The first control unit preferably has a label of the predetermined operation that is associated with the first button. The second control unit preferably has a label of the predetermined operation that is associated with the second button. The label of the predetermined operation on the first control unit preferably has a bigger size than that of the predetermined operation on the second control unit. The image control section preferably makes the size of the particular image to be presented when the receiving section receives the first control signal bigger than that of the particular image to be presented when the receiving section receives the second control signal.

In still another preferred embodiment, the first control unit preferably has a first button and preferably outputs the first control signal when the first button is pushed. The second control unit preferably has a second button and preferably outputs the second control signal when the second button is pushed. The first control unit preferably has a smaller number of buttons than the second control unit. The image control section preferably makes the size of the particular image to be presented when the receiving section receives the first control signal bigger than that of the particular image to be presented when the receiving section receives the second control signal.

In yet another preferred embodiment, the image control section preferably changes the sizes of the particular image while maintaining the status of the operation that has been performed until the sizes of the particular image are changed.

In yet another preferred embodiment, the first and second control units are preferably remote controllers, and the appliance is preferably one of a display device, a player, a recorder, a recorder/player and an image editor.

In yet another preferred embodiment, if the receiving section has received the first control signal, the image control section preferably presents an interface that connects the user of the appliance to a support center.

In this particular preferred embodiment, if the receiving section has received the second control signal, the image control section preferably hides the interface.

An appliance according to another preferred embodiment of the present invention operates under an instruction from a control unit. The control unit has a first button and outputs a first control signal to the appliance to instruct the appliance to perform a predetermined operation when the first button is pushed. The control unit also has a second button and outputs a second control signal to the appliance to instruct the appliance to perform the predetermined operation when the second button is pushed. The appliance includes: a receiving section that receives the first and second control signals; and an image control section that changes sizes of a particular image to be presented during the predetermined operation depending on whether the receiving section has received the first control signal or the second control signal.

In one preferred embodiment of the present invention, the first button preferably has a bigger size than the second button. The image control section preferably makes the size of the particular image to be presented when the receiving section receives the first control signal bigger than that of the particular image to be presented when the receiving section receives the second control signal.

In another preferred embodiment, the control unit preferably has labels of the predetermined operation that are associated with the first and second buttons, respectively. The label of the predetermined operation associated with the first button preferably has a bigger size than that of the predetermined operation associated with the second button. The image control section preferably makes the size of the particular image to be presented when the receiving section receives the first control signal bigger than that of the particular image to be presented when the receiving section receives the second control signal.

A remote control system according to a preferred embodiment of the present invention preferably includes a plurality of control units, and an appliance that is operative under instructions from the control units, which include a first control unit and a second control unit. The first control unit outputs a first control signal to the appliance to instruct the appliance to perform a predetermined operation. The second control unit outputs a second control signal to the appliance to instruct the appliance to perform the predetermined operation. The appliance includes: a receiving section that receives the first and second control signals; and an image control section that changes sizes of a particular image to be presented during the predetermined operation depending on whether the receiving section has received the first control signal or the second control signal.

A remote control system according to another preferred embodiment of the present invention preferably includes a control unit, and an appliance that operates under an instruction from the control unit. The control unit has a first button and outputs a first control signal to the appliance to instruct the appliance to perform a predetermined operation when the first button is pushed. The control unit also has a second button and outputs a second control signal to the appliance to instruct the appliance to perform the predetermined operation when the second button is pushed. The appliance includes: a receiving section that receives the first and second control signals; and an image control section that changes sizes of a particular image to be presented during the predetermined operation depending on whether the receiving section has received the first control signal or the second control signal.

An appliance according to a preferred embodiment of the present invention changes the sizes of a particular image (such as a letter, a sign, a picture or an interface) to be displayed while performing a predetermined operation (such as recording, playback, editing or setting) depending on which of a plurality of control units (e.g., remote controllers) has output the control signal received. That is to say, when the user changes the control units to use, the appliance changes the sizes of such an image automatically. As a result, an image, of which the size has been adjusted to the individual user, can be displayed without having the user change the settings of the control unit or the appliance by himself or herself.

An appliance according to another preferred embodiment of the present invention changes the sizes of a particular image to be presented while performing a predetermined operation depending on which of multiple buttons of a single control unit, associated with the same predetermined operation, has been pushed. That is to say, when the user changes the buttons to push, the appliance changes the sizes of such an image automatically. As a result, an image, of which the size has been adjusted to the individual user, can be displayed without having the user change the settings of the control unit or the appliance by himself or herself.

These functions of the appliance and control units of the present invention are defined in advance when the product ships from its manufacturing factory. According to the present invention, the user can change the degrees of visibility of the image such as an interface and the levels of required operational skills both easily and instinctively. As a result, users who want to use complicated functions and users who want to use only simple functions can share the same audio-visual system.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 4 shows a remote controller code table according to the first preferred embodiment.

DETAILED DESCRIPTION OF PREFERRED EMBODIMENTS

Hereinafter, preferred embodiments of the present invention will be described with reference to the accompanying drawings.

Embodiment 1

Figure 1:
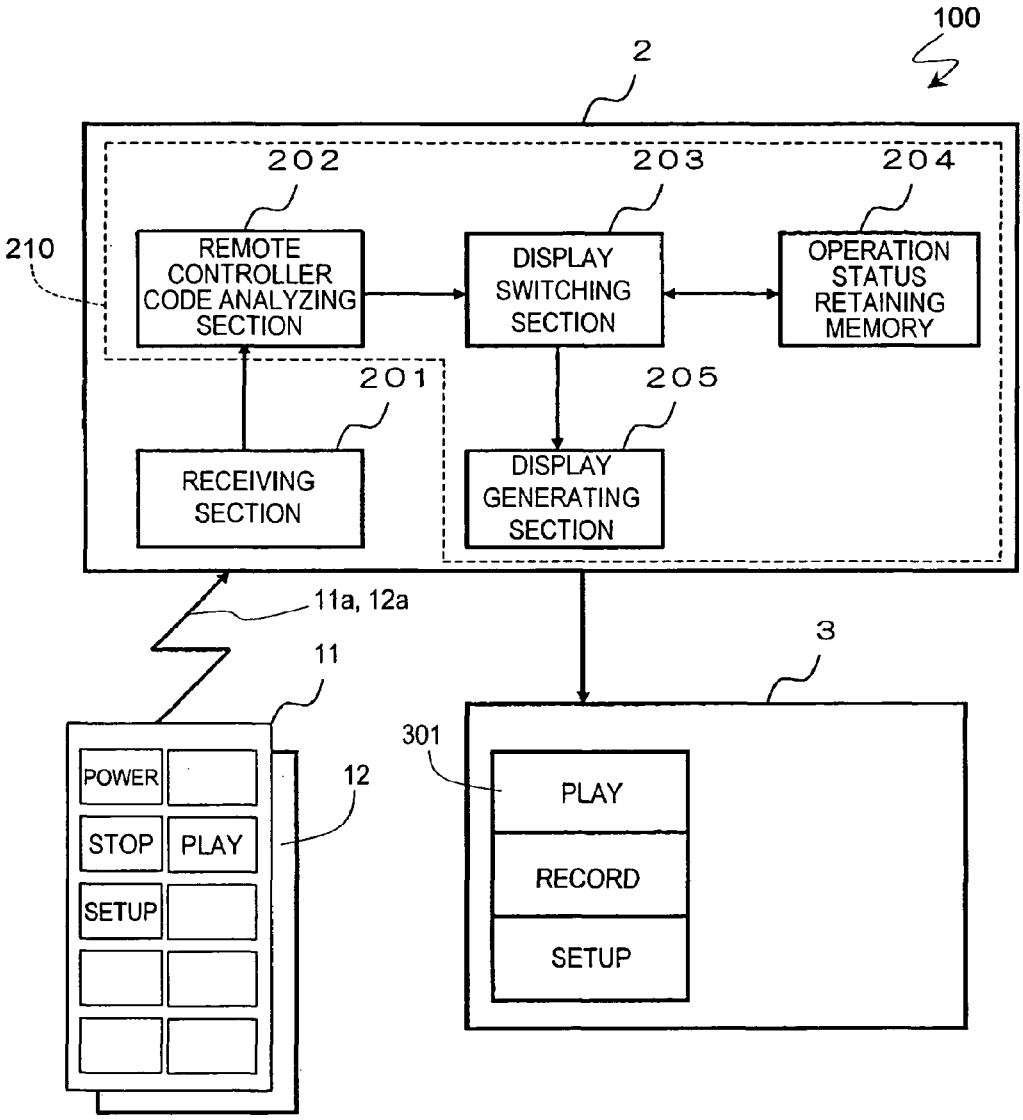
FIG. 1 shows a remote control system according to a first preferred embodiment of the present invention.

First, a remote control system 100 according to a first specific preferred embodiment of the present invention will be described with reference to FIG. 1, which schematically shows the remote control system 100. As shown in FIG. 1, the remote control system 100 includes remote controllers 11 and 12, an appliance 2 that operates under the instructions given by the remote controllers 11 and 12, and a display 3 for presenting an image thereon by processing an image signal supplied from the appliance 2.

The remote controllers 11 and 12 function as control units for controlling the operation of the appliance 2 by respectively outputting control signals 11*a* and 12*a* to the appliance 2. The appliance 2 is preferably an AV appliance such as a player, a recorder, a recorder/player or an image editor. The appliance 2 may read and/or write information from/on an optical disk such as a DVD, for example. Optionally, the appliance 2 may also be a display device such as a TV receiver. In that case, the display 3 is included in the appliance 2.

Next, the remote controllers 11 and 12 will be described with reference to FIGS. 2A and 2B, which schematically illustrate the remote controllers 11 and 12, respectively.

The remote controller 11 includes a relatively small number of buttons including buttons 111, 112 and 113. Meanwhile, the remote controller 12 includes a relatively large number of buttons including buttons 121, 122 and 123. Each of those buttons of the remote controllers 11 and 12 has a printed label of its associated function, which may be letters, a sign or a picture, for example, and may be printed on or around its associated button.

Figure 2A:
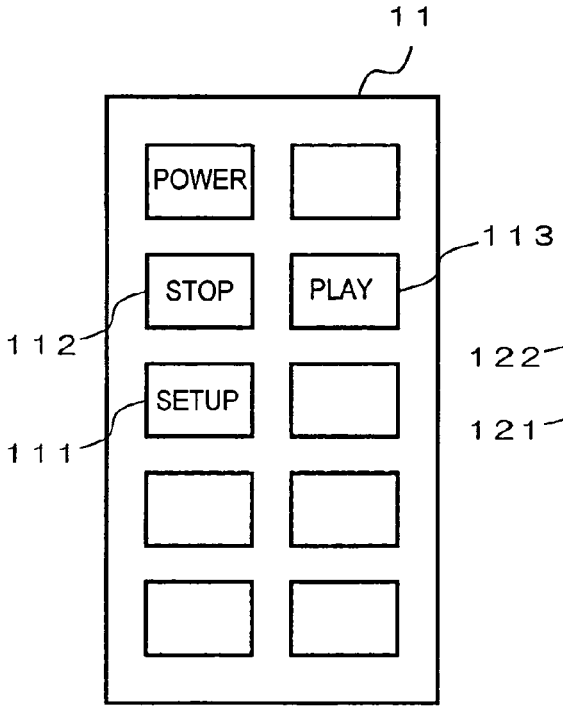
FIGS. 2A and 2B illustrate remote controllers for use in the first preferred embodiment.
Figure 2B:
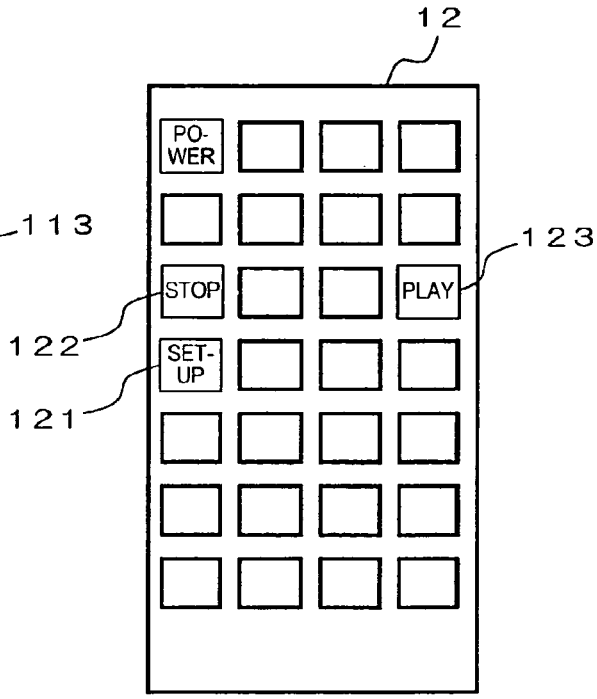

In the examples illustrated in FIGS. 2A and 2B, the letters "setup" are printed on the surface of the buttons 111 and 121, the letters "stop" are printed on the surface of the buttons 112 and 122, and the letters "play" are printed on the buttons 113 and 123. When the user pushes a button with a printed label of his or her desired function, the remote controller 11 or 12 outputs a control signal, which instructs the appliance 2 to perform an operation associated with the button pushed, to the appliance 2.

The size of the buttons of the remote controller 11 is bigger than that of the buttons of the remote controller 12. Also, the size of each function label printed on the remote controller 11 is bigger than that of each function label printed on the remote controller 12. The differences in the size between these two sets of buttons and between these two sets of function labels are big enough to recognize instantly for most people. Also, the number of buttons on the remote controller 11 is smaller than that of buttons on the remote controller 12. Due to these features, the remote controller 11 has a higher degree of visibility, is much easier to use, and therefore, will be welcome to users who want to use only simple functions. On the other hand, the remote controller 12 provides a lesser degree of visibility, is far from being easy to use, but enables the user to perform a lot of complicated operations by manipulating a greater number of buttons and will be welcome to those who wish to use such advanced functions.

Some pairs of buttons of the remote controllers 11 and 12 are associated with common functions. For example, the SETUP buttons 111 and 121 are both used to instruct the appliance 2 to perform the same function of getting a setting menu presented on the display 3. However, the SETUP button 111 has a bigger size and a bigger function label than the SETUP button 121. When the SETUP buttons 111 and 121 are pushed, the remote controllers 11 and 12 output their respective control signals. The information represented by the control signal that has been output from the remote controller 11 to instruct the appliance 2 to perform the same function of getting the setting menu presented is different from that represented by the control signal that has been output from the remote controller 12 for the same purpose as will be described more fully later. These control signals may be infrared radiations, for example. When the user presses the SETUP button 111, icons 301, etc. may be presented as the setting menu on the display 3, for instance.

As shown in FIG. 1, the appliance 2 includes a receiving section 201 that receives the control signals from the remote controllers 11 and 12 and an image control section 210 that generates an image signal representing an image to be presented on the display 3 in accordance with the control signal received. The image control section 210 includes a remote controller code analyzing section 202, a display switching section 203, an operation status retaining memory 204 and a display generating section 205. The image control section 210 changes the sizes of a particular image to be presented on the display 3 during the same predetermined operation depending on whether the receiving section 201 has received the control signal from the remote controller 11 or the control signal from the remote controller 12.

Figure 3A:
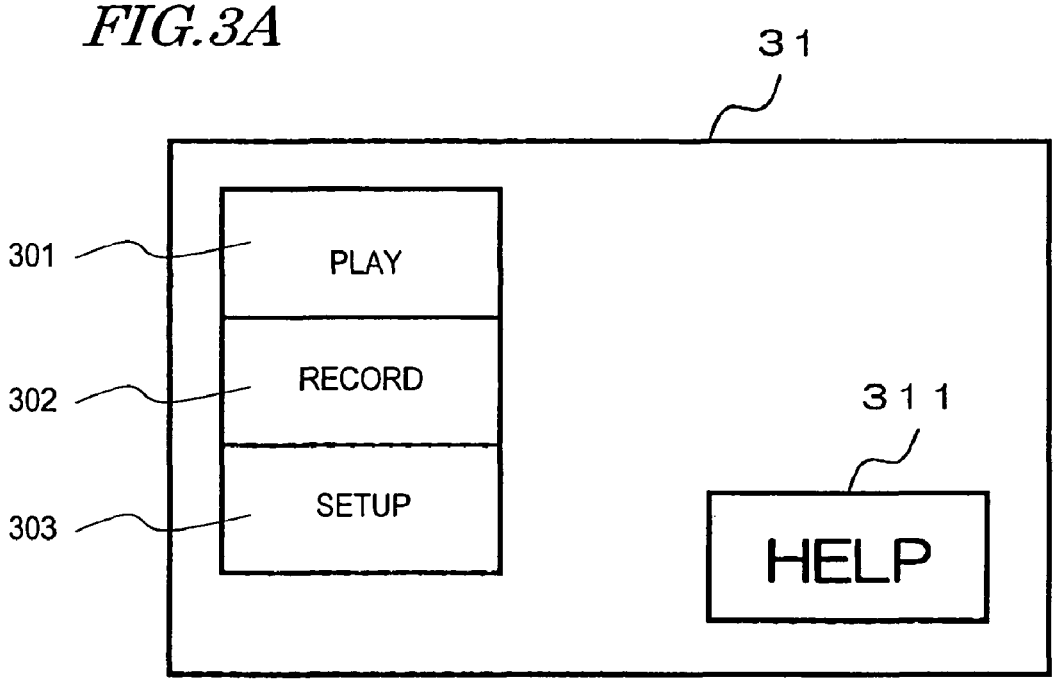
FIGS. 3A and 3B illustrate interfaces according to the first preferred embodiment.
Figure 3B:
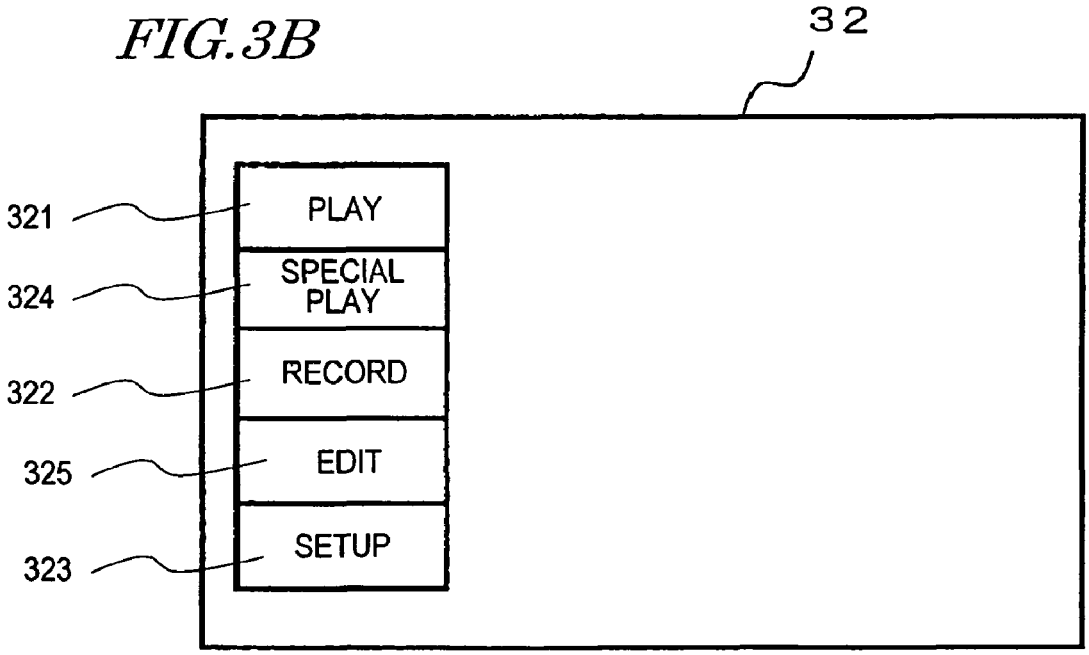

FIG. 3A shows a graphical user interface (GUI) 31 as an exemplary image to be presented on the display 3 when the SETUP button 111 of the remote controller 11 is pushed. Meanwhile, FIG. 3B shows a GUI 32 as an exemplary image to be presented on the display 3 when the SETUP button 121 of the remote controller 12 is pushed. The GUI 31 includes icons 301, 302, 303 and 311. The GUI 32 includes icons 321, 322, 323, 324 and 325.

As shown in FIG. 3A, the GUI 31 has a smaller number of bigger icons 301 to 303 and 311 with letters in a bigger font size so as to share the features of the remote controller 11 (having a smaller number of bigger buttons with bigger function labels) that will be welcome to users who want to use only simple functions. Thanks to these features, the GUI 31 has a higher degree of visibility, is much easier to use, and therefore should be comfortable for users who just need simple functions. The size of the icons 301 to 303 and 311 is bigger than that of the icons 321 to 325. And the font size of the GUI 31 is bigger than that of the GUI 32.

On the other hand, the GUI 32 shown in FIG. 3B has a greater number of smaller icons 321 to 325 with letters in a smaller font size so as to share the features of the remote controller 12 (having a larger number of smaller buttons with smaller function labels) that will please users who wish to use complicated functions. Due to these features, the GUI 32 has a lower degree of visibility, is far from being easily usable, but enables the user to perform a lot of complicated operations by using a greater number of icons, and therefore, should be comfortable for those who want to use advanced functions fully.

The receiving section 201 converts the received control signal into a remote controller code and then outputs the code to the remote controller code analyzing section 202. The remote controller code may be represented by a two-digit numeral, for example. And the remote controllers 11 and 12 are provided with independent remote controller codes.

The remote controller code analyzing section 202 analyzes the received remote controller code by reference to a remote controller code table stored there in advance. FIG. 4 shows the remote controller code table 206 stored in the remote controller code analyzing section 202. In the remote controller code table 206, the remote controller codes assigned to the respective buttons are associated with screen display mode specifying data and operation instructing data, which are both digital data represented by arrangements of zeros and ones. More specifically, the screen display mode specifying data specifies the details of the image to be presented on the display 3, including the sizes of letters, signs and pictures and the number of icons, while the operation instructing data shows what operation should be done by the appliance 2.

For example, the SETUP button 111 is associated with the remote controller code "00", which is converted by the remote controller code analyzing section 202 into the screen display mode specifying data "00" and the operation instructing data "00000100". Meanwhile, the SETUP button 121 is associated with the remote controller code "50", which is converted by the remote controller code analyzing section 202 into the screen display mode specifying data "01" and the operation instructing data "00000100". Then, the remote controller code analyzing section 202 outputs the screen display mode specifying data and the operation instructing data to the display switching section 203.

The display switching section 203 stores in advance a plurality of screen display programs for the respective screen display mode specifying data. Each of those screen display programs has settings about the details of the image presented on the display 3 (e.g., the sizes of letters, signs and pictures and the number of icons).

On receiving the screen display mode specifying data and the operation instructing data, the display switching section 203 determines whether or not the screen display program being currently executed is associated with the screen display mode specifying data received. If the answer is YES, the display switching section 203 does not change the screen display programs. Otherwise, the display switching section 203 switches the currently executed screen display program into a screen display program associated with the screen display mode specifying data received. In that case, first, the display switching section 203 gets data representing the current operation status of the appliance 2 (i.e., the operation status just before the latest control signal is received) stored on the operation status retaining memory 204, which may be a DRAM or a flash memory, for example. The data representing the current operation status contains various kinds of information about the operations being performed by the appliance 2, including setting, playing, recording, rate of fast forwarding, rate of rewinding, TV channel selected, and screen display mode. If the data to be presented next is not generated based on the current screen display mode, then the data about the screen display mode does not have to be saved.

Next, the display switching section 203 reads the screen display program associated with the screen display mode specifying data received and then switches the currently executed screen display program into the newly read screen display program. Subsequently, the display switching section 203 reads the data representing the operation status from the operation status retaining memory 204, generates image data to present an image, associated with the operation status and the operation instructing data, on the display 3, and then outputs the data to the display generating section 205. If the screen display programs have been switched, the details of the image presented on the display 3 (e.g., the sizes of letters, signs and pictures and the number of icons) are changed in accordance with the newly executed screen display program. In response, the display generating section 205 converts the image data received into an image signal in a format compatible with the display 3 and then outputs it to the display 3. As a result, the image is presented on the display 3.

Figure 5:
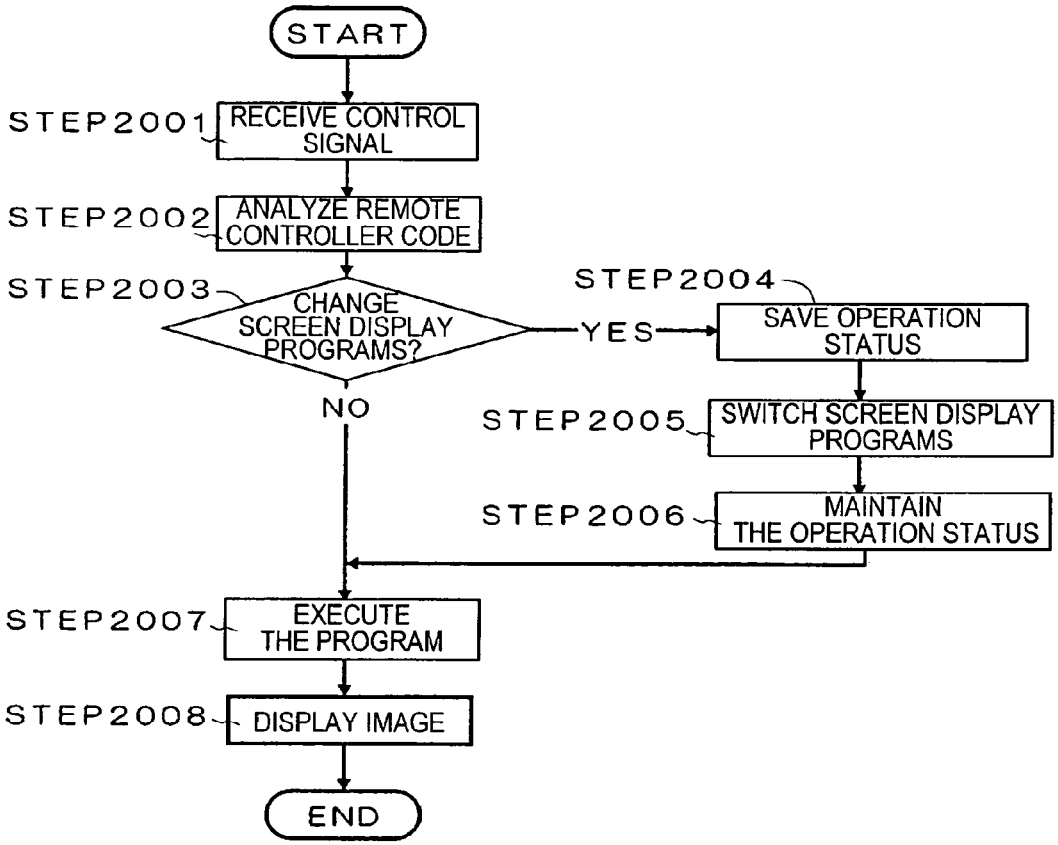
FIG. 5 is a flowchart showing how the remote control system of the first preferred embodiment operates.

Hereinafter, the operation of the remote control system 100 will be described in further detail with reference to FIG. 5, which is a flowchart showing how the remote control system 100 operates. In the following example, it will be described how the remote control system 100 operates in a situation where while a user is using the remote controller 11 to get the GUI 31 shown in FIG. 3A presented on the display 3, the remote controller 11 is replaced with the remote controller 12 due to the switch of the users, for example, and the SETUP button 121 is pushed.

First, in Step 2001, the receiving section 201 receives a control signal that was output from the remote controller 12 when the SETUP button 121 was pushed. The receiving section 201 converts the received control signal into the remote controller code "50" and outputs the remote controller code "50" to the remote controller code analyzing section 202.

Next, in Step 2002, the remote controller code analyzing section 202 converts the remote controller code "50" into the screen display mode specifying data "01" and the operation instructing data "00000100" by reference to the remote controller code table 206 (see FIG. 4) and then outputs both of these data to the display switching section 203.

Subsequently, in Step 2003, the display switching section 203 determines whether or not the currently executed screen display program is associated with the screen display mode specifying data "01" received. If the answer is YES, then there is no need to change the screen display programs and the process advances to Step 2007. Otherwise, the screen display programs need to be changed and the process advances to Step 2004. In this example, the currently executed screen display program is associated with the screen display mode specifying data "00" and the screen display programs need to be changed. That is why the process advances to Step 2004.

In Step 2004, the data representing the current operation status of the appliance 2 (i.e., the "setting menu presented" status in this example) is stored on the operation status retaining memory 204 for the purpose of migration.

Next, in Step 2005, the display switching section 203 reads the screen display program associated with the screen display mode specifying data "01" and switches the currently executed screen display program into the newly read screen display program and gets it executed.

Thereafter, in Step 2006, the display switching section 203 reads the data representing the operation status from the operation status retaining memory 204 and maintains (holds) that operation status (i.e., the "setting menu presented" status in this example).

Subsequently, in Step 2007, the display switching section 203 generates image data to present an image, associated with the read data representing the operation status and the operation instructing data "00000100", on the display 3 following the newly executed screen display program, and outputs the data to the display generating section 205. In this example, the details of the image presented on the display 3 (e.g., the sizes of letters, signs and pictures and the number of icons) are switched while the same operation status "setting menu presented" is maintained.

Finally, in Step 2008, the display generating section 205 converts the image data to an image signal in a format compatible with the display 3 and then outputs the signal to the display 3, thereby presenting an image on the display 3. In this example, the images presented on the display 3 are switched from the GUI 31 shown in FIG. 3A into the GUI 32 shown in FIG. 3B.

As described above, if the user is operating the remote controller 11, then the appliance 2 presents a highly visible and easily operable interface such as the GUI 31 responsive to the manipulation of the remote controller 11. On the other hand, if the user is operating the remote controller 12, then the appliance 2 presents an interface that provides a lesser degree of visibility but that enables the user to perform a greater number of functions such as the GUI 32. In this manner, when the user changes the remote controllers to use, the appliance 2 automatically changes the sizes and other parameters of the image presented. As a result, the best GUI or any other image can be displayed so as to please the individual user without forcing him or her to make troublesome settings of the remote controllers 12 and the appliance 2 by himself or herself.

It should be noted that the interface to be presented as the remote controller 11 for beginners or non-skilled users is manipulated may include an icon for using a HELP function such as the icon 311 shown in FIG. 3A. The HELP icon 311 may be presented on a window for setting the appliance or on a window for presetting the timer recording operation of a program, for example. Then, an interface that should satisfy beginners and non-skilled users even more perfectly is realized. However, such an HELP icon 311 is not necessary for skilled users. That is why the HELP icon 311 does not have to be displayed when the GUI 32 is presented.

Optionally, the HELP icon 311 may also be an interface that connects the user to a support center. For example, if the appliance 2 includes a phone line modem (not shown) and if the user has selected the HELP icon 311, then the appliance 2 may start a phone communication with the support center and the user may operate the appliance 2 in accordance with the guidance of an operator at the support center.

Also, if the remote controllers have been switched for some reason, the operation status of the appliance before the controllers were switched may be retained in the operation status retaining memory 204 (see FIG. 1). And when the previous remote controller starts to be used again, the appliance may start the suspended operation, of which the status is memorized, all over again. Then, the appliance 2 can be used in common more conveniently. For example, suppose after a user has suspended an editing operation using the remote controller 12, another user gets a playback operation performed using the remote controller 11 and then the former user restarts the editing operation all over again by using the remote controller 12. In that case, the person who wants to edit may restart his or her editing operation from exactly where he or she stopped.

In the example shown in FIGS. 2A and 2B, the size of every button on the remote controller 11 is different from that of the counterpart on the remote controller 12. However, similar effects are also achieved even if just some of the buttons on the remote controller 11 have a different size from the counterparts on the remote controller 12.

Furthermore, similar effects are also achievable even if the buttons on the remote controller 11 are almost as big as those on the remote controller 12 but if the number of buttons on the remote controller 11 is different from that of buttons on the remote controller 12. Optionally, the remote controllers 11 and 12 may also have different sizes or designs, for example.

As another alternative, a single remote controller may have multiple buttons that are associated with the same operation such that a GUI with a relatively small number of selectable functions is presented if a highly visible one of the buttons has been pushed and that a GUI with a relatively large number of selectable functions is presented if a less visible button has been pushed. Then, it would be easier for a beginner to select his or her desired function with highly sophisticated functions hidden.

Two remote controllers are used in the preferred embodiment described above. But the same effects are achievable even if three or more remote controllers are used.

According to the preferred embodiment described above, when the user switches the remote controllers to use, the appliance 2 changes the degrees of visibility and operability of an image such as an interface while maintaining the same operation status. That is to say, since the visibility and operability of the image can be changed just by switching the remote controllers to use, the users who want to use advanced functions and the users who just need to use simple functions can share the same appliance 2 easily.

Embodiment 2

Figures 6, 7:
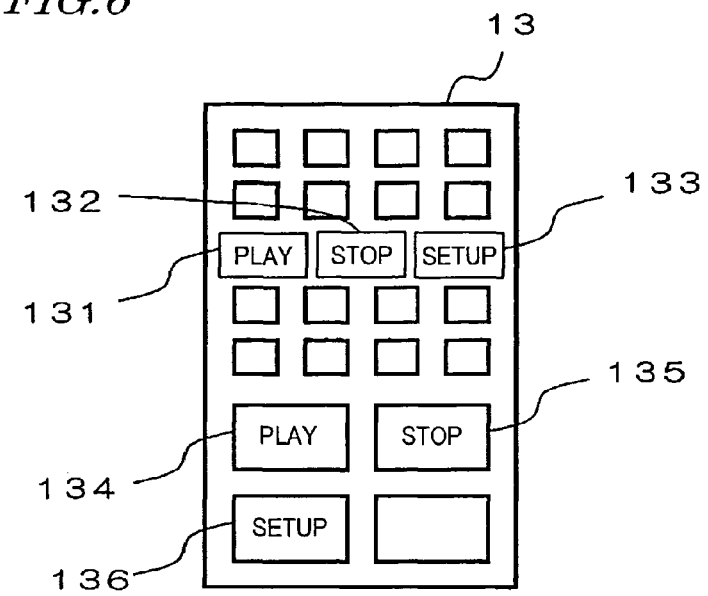
FIG. 6 shows a remote controller for use in a second preferred embodiment of the present invention.
FIG. 7 shows a remote controller code table according to the second preferred embodiment.

According to a second specific preferred embodiment of the present invention, the remote control system 100 shown in FIG. 1 includes a remote controller 13 such as that shown in FIG. 6, instead of the remote controllers 11 and 12. That is to say, just one remote controller is used in this preferred embodiment. FIG. 6 schematically illustrates the remote controller 13.

The remote controller 13 includes a plurality of buttons including buttons 131 to 136. Each of these buttons has a printed label of its associated function, which may be letters, a sign or a picture, for example, and may be printed on or around its associated button. The buttons 134 to 136 have a bigger size than the buttons 131 to 133. Also, the size of the function label printed on the buttons 134 to 136 is bigger than that of the function label printed on the buttons 131 to 133. The differences in size between these two sets of buttons and between these two sets of function labels are big enough to recognize instantly for most people.

In the example illustrated in FIG. 6, the buttons 131 and 134 are associated with the same function "play", the buttons 132 and 135 are associated with the same function "stop", and the buttons 133 and 136 are associated with the same function "setup".

Among these buttons, the buttons 133 and 136 will be described in detail. Both of these buttons 133 and 136 are used to get a setting menu presented on the display 3. However, the SETUP button 136 has a bigger size and a bigger function label than the SETUP button 133. When the SETUP button 133 or 136 is pushed, the remote controller 13 outputs a control signal to get the setting menu presented on the display 3. The information represented by the control signal that was output from the remote controller 13 when the SETUP button 133 was pushed is different from that represented by the control signal that was output from the remote controller 13 when the SETUP button 136 was pushed.

The image control section 210 changes the sizes of an image to be presented on the display 3 during the setting operation depending on whether the control signal received from the remote controller 13 was responsive to the pressure on the SETUP button 133 or on the SETUP button 136. If the button 136 has been pushed, the GUI 31 having a smaller number of bigger icons with letters in a bigger font size is presented so as to share the feature of the button 136 (having a bigger size with a bigger function label). On the other hand, if the button 133 has been pushed, the GUI 32 having a larger number of smaller icons with letters in a smaller font size is presented so as to share the feature of the button 133 (having a smaller size with a smaller function label).

Considering these features, the buttons 134 to 136 have a higher degree of visibility, are much easier to use, and therefore should be comfortable for users who just need simple functions. On the other hand, the buttons 131 to 133 have a lesser degree of visibility, are far from being easy to use, but enable the user to perform a lot of complicated operations and will be welcome to those who wish to use such advanced functions.

The appliance 2 of this preferred embodiment operates basically in the same way as the counterpart already described for the first preferred embodiment, and the detailed description thereof will be omitted herein. Unlike the first preferred embodiment, the remote controller code analyzing section 202 of this preferred embodiment uses the remote controller code table 207 shown in FIG. 7 instead of the remote controller code table 206 shown in FIG. 4 and analyzes the remote controller code that has been output from the receiving section 201. In the remote controller code table 207, the remote controller codes assigned to the respective buttons of the remote controller 13 are associated with screen display mode specifying data and operation instructing data.

For example, the SETUP button 136 is associated with the remote controller code "02", which is converted by the remote controller code analyzing section 202 into the screen display mode specifying data "00" and the operation instructing data "00000100". Meanwhile, the SETUP button 133 is associated with the remote controller code "05", which is converted by the remote controller code analyzing section 202 into the screen display mode specifying data "01" and the operation instructing data "00000100". Then, the remote controller code analyzing section 202 outputs the screen display mode specifying data and the operation instructing data to the display switching section 203. In response, the display switching section 203 generates image data in accordance with the screen display mode specifying data and the operation instructing data as in the first preferred embodiment described above. And the display 3 presents either the GUI 31 or the GUI 32 based on the image data.

Optionally, either or both of the two buttons associated with the same function may be covered with a lid, for instance. For example, if the buttons 131 to 133 are covered with a lid, then the buttons 134 to 136 can be made even more visible. And when needed, the buttons 131 to 133 may be exposed by opening the lid.

Two buttons are associated with the same function in the preferred embodiment described above. But the same effects are achievable even if three or more buttons are associated with the same function.

According to the preferred embodiment described above, when the user changes the sizes of the buttons to push, the appliance 2 changes the degrees of visibility and operability of an image such as an interface while maintaining the same operation status. That is to say, since the visibility and operability of the image can be changed just by changing the sizes of the buttons to push, the users who want to use advanced functions and the users who just need to use simple functions can share the same appliance 2 easily.

Embodiment 3

Figure 8:
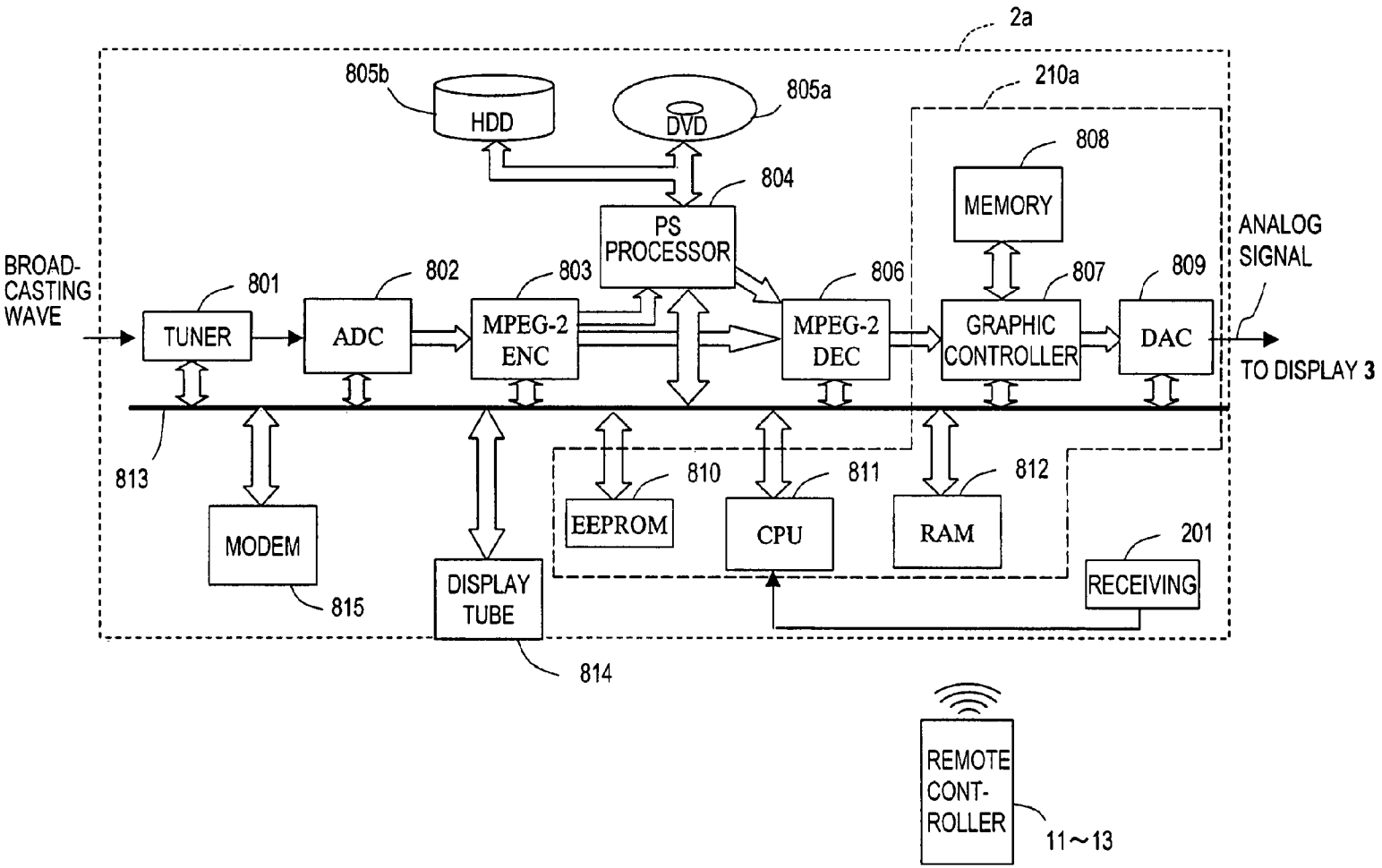
FIG. 8 shows an appliance according to a third preferred embodiment of the present invention.

The functions of the appliance 2 that have been described for the first and second preferred embodiments may be carried out at least partially by a computer executable program. Thus, an appliance that operates following such a program will be described as a third specific preferred embodiment of the present invention with reference to FIG. 8, which schematically illustrates an appliance 2*a* according to the third preferred embodiment. However, the operation carried out by this appliance 2*a* is substantially the same as that carried out by the appliance 2.

The appliance 2*a* may be a DVD recorder with a hard disk drive 805*b* and may be loaded with a DVD 805*a*.

The appliance 2*a* includes the receiving section 201 and an image control section 210*a*. Following a program, the image control section 210*a* performs substantially the same operation as the image control section 210 shown in FIG. 1. The image control section 210*a* includes a graphic controller 807, a memory 808, a D/A converter 809, an EEPROM 810, a central processing unit (CPU) 811 and a RAM 812.

The appliance 2*a* further includes a tuner 801, an A/D converter 802, a Moving Picture Experts Group (MPEG)-2 encoder 803, a postscript (PS) processor 804, an MPEG-2 decoder 806, a display tube 814 and a modem 815. Among these components of the appliance 2*a*, data may be transmitted and received through a bus 813.

The video/audio information included in a broadcasting wave is converted by the tuner 801 and A/D converter 802 into a digital signal, which is then encoded by the MPEG-2 encoder 803. The PS processor 804 writes the encoded video/audio information on either the hard disk drive 805*b* or on the DVD 805*a*. Also, the PS processor 804 reads encoded information from either the hard disk drive 805*b* or the DVD 805*a* and then outputs it to the MPEG-2 decoder 806. In response, the MPEG-2 decoder 806 decodes the encoded information and then outputs the decoded data to the graphic controller 807. The display tube 814 presents the operation status of the appliance 2*a*, the time and so on. The modem 815 is an interface that connects the user to a support center by way of the HELP icon 311 (see FIG. 3A) and carries out a phone communication between the user and the support center when the HELP icon 311 is selected.

The EEPROM 810, which is a nonvolatile memory, stores thereon a control program, a remote controller code table, a screen display program and so on to operate the CPU 811 and the graphic control section 207. When the appliance 2*a* is started, the CPU 811 and the graphic controller 807 read out the control program from the EEPROM 810 and execute the program. The CPU 811 also reads the remote controller code table from the EEPROM 810. The graphic controller 807 further reads the screen display program. The CPU 811 controls the overall operation of the appliance 2*a* and performs substantially the same operation as the remote controller code analyzing section 202 (see FIG. 1). The graphic controller 807 and the memory 808 operate in substantially the same way as the display switching section 203 and the operation status retaining memory 204, respectively. Furthermore, the D/A converter 809 operates in almost the same way as the display generating section 205.

The receiving section 201 receives a control signal from the remote controller 11, 12 or 13, converts the control signal into a remote controller code, and then outputs the code to the CPU 811. By reference to the remote controller code table, the CPU 811 converts the received remote controller code into the screen display mode specifying data and operation instructing data and gets these data stored on the RAM 812. Furthermore, the CPU 811 changes the operation statuses of the appliance 2*a* according to the contents of the operation instructing data (e.g., from the stop status into the recording status).

The graphic controller 807 reads the screen display mode specifying data and operation instructing data from the RAM 812. Also, the graphic controller 807 generates image data in accordance with the operation instructing data and the screen display mode specifying data following a screen display program. If the screen display programs have been switched, the details of the image to be presented on the display 3 (e.g., the sizes of letters, signs or pictures or the number of icons) change according to the newly executed screen display program. The D/A converter 809 converts the image data into an analog image signal in a format compatible with the display 3 and then outputs the signal to the display 3. As a result, an image is presented on the display 3.

As described above, the appliance 2*a* carries out substantially the same functions as the appliance 2 following a program. Thus, the appliance 2*a* can also achieve the effects of the present invention as already described for the first and second preferred embodiments.

The present invention can be used particularly effectively in the field of audiovisual appliances that use a remote controller or any other control unit.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Applications No. 2004-311765 filed on Oct. 27, 2004 and No. 2005-302129 filed on Oct. 17, 2005, the entire contents of which are hereby incorporated by reference.

The invention claimed is:

1. An appliance that is operative under instructions from a plurality of control units, which includes a first control unit and a second control unit, wherein the first control unit outputs a first control signal to the appliance to instruct the appliance to perform a predetermined operation, and wherein the second control unit outputs a second control signal to the appliance to instruct the appliance to perform the predetermined operation, and wherein the appliance comprises:

a receiving section that receives the first and second control signals; and an image control section that changes sizes of a command icon for the predetermined operation to a first display size independent of a distance between the first control unit and a display for presenting the command icon thereon when the receiving section has received the first control signal or to a second display size, different from the first display size, independent of a distance between the second control unit and the display when the receiving section has received the second control signal.

2. The appliance of claim 1, wherein the first control unit has a first button and outputs the first control signal when the first button is pushed, and wherein the second control unit has a second button and outputs the second control signal when the second button is pushed, and wherein the first button has a bigger size than the second button, and wherein the image control section makes the size of the command icon to be presented when the receiving section receives the first control signal bigger than that of the command icon to be presented when the receiving section receives the second control signal.

3. The appliance of claim 1, wherein the first control unit has a first button and outputs the first control signal when the first button is pushed, and wherein the second control unit has a second button and outputs the second control signal when the second button is pushed, and wherein the first control unit has a label of the predetermined operation that is associated with the first button, and wherein the second control unit has a label of the predetermined operation that is associated with the second button, and wherein the label of the predetermined operation on the first control unit has a bigger size than that of the predetermined operation on the second control unit, and wherein the image control section makes the size of the command icon to be presented when the receiving section receives the first control signal bigger than that of the command icon to be presented when the receiving section receives the second control signal.

4. The appliance of claim 1, wherein the first control unit has a first button and outputs the first control signal when the first button is pushed, and wherein the second control unit has a second button and outputs the second control signal when the second button is pushed, and wherein the first control unit has a smaller number of buttons than the second control unit, and wherein the image control section makes the size of the command icon to be presented when the receiving section receives the first control signal bigger than that of the command icon to be presented when the receiving section receives the second control signal.

5. The appliance of claim 1, wherein the image control section changes the sizes of the command icon while maintaining the status of the operation that has been performed until the sizes of the command icon are changed.

6. The appliance of claim 1, wherein the first and second control units are remote controllers, and wherein the appliance is one of a display device, a player, a recorder, a recorder/player and an image editor.

7. The appliance of claim 1, wherein if the receiving section has received the first control signal, the image control section presents an interface that connects the user of the appliance to a support center.

8. The appliance of claim 7, wherein if the receiving section has received the second control signal, the image control section hides the interface.

9. An appliance that operates under an instruction from a control unit, wherein the control unit has a first button and outputs a first control signal to the appliance to instruct the appliance to perform a predetermined operation when the first button is pushed, and wherein the control unit also has a second button and outputs a second control signal to the appliance to instruct the appliance to perform the predetermined operation when the second button is pushed, and wherein the appliance comprises:

a receiving section that receives the first and second control signals; and an image control section that changes sizes of a command icon for the predetermined operation to a first display size independent of a distance between the control unit and a display for presenting the command icon thereon when the receiving section has received the first control signal or to a second display size, different from the first display size, independent of the distance when the receiving section has received the second control signal.

10. The appliance of claim 9, wherein the first button has a bigger size than the second button, and wherein the image control section makes the size of the command icon to be presented when the receiving section receives the first control signal bigger than that of the command icon to be presented when the receiving section receives the second control signal.

11. The appliance of claim 9, wherein the control unit has labels of the predetermined operation that are associated with the first and second buttons, respectively, and wherein the label of the predetermined operation associated with the first button has a bigger size than that of the predetermined operation associated with the second button, and wherein the image control section makes the size of the command icon to be presented when the receiving section receives the first control signal bigger than that of the command icon to be presented when the receiving section receives the second control signal.

12. A remote control system comprising a plurality of control units, and an appliance that is operative under instructions from the control units, which include a first control unit and a second control unit, wherein the first control unit outputs a first control signal to the appliance to instruct the appliance to perform a predetermined operation, and wherein the second control unit outputs a second control signal to the appliance to instruct the appliance to perform the predetermined operation, and wherein the appliance comprises:

a receiving section that receives the first and second control signals; and an image control section that changes sizes of a command icon for the predetermined operation to a first display size independent of a distance between the first control unit and a display for presenting the command icon thereon when the receiving section has received the first control signal or to a second display size, different from the first display size, independent of a distance between the second control unit and the display when the receiving section has received the second control signal.

13. A remote control system comprising a control unit, and an appliance that operates under an instruction from the control unit, wherein the control unit has a first button and outputs a first control signal to the appliance to instruct the appliance to perform a predetermined operation when the first button is pushed, and wherein the control unit also has a second button and outputs a second control signal to the appliance to instruct the appliance to perform the predetermined operation when the second button is pushed, and wherein the appliance comprises:

a receiving section that receives the first and second control signals; and an image control section that changes sizes of a command icon for the predetermined operation to a first display size independent of a distance between the control unit and a display for presenting the command icon thereon when the receiving section has received the first control signal or to a second display size, different from the first display size, independent of the distance when the receiving section has received the second control signal.

* * * * *